US012055325B2

(12) United States Patent
Kim et al.

(10) Patent No.: US 12,055,325 B2
(45) Date of Patent: Aug. 6, 2024

(54) ROTARY COMPRESSOR AND HOME APPLIANCE INCLUDING THE SAME

(71) Applicant: SAMSUNG ELECTRONICS CO., LTD., Suwon-si (KR)

(72) Inventors: Joonhyung Kim, Suwon-si (KR); Munseong Kwon, Suwon-si (KR); Jaewoo Park, Suwon-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 0 days.

(21) Appl. No.: 18/323,551

(22) Filed: May 25, 2023

(65) Prior Publication Data

US 2023/0407877 A1 Dec. 21, 2023

Related U.S. Application Data

(63) Continuation of application No. PCT/KR2023/005881, filed on Apr. 28, 2023.

(30) Foreign Application Priority Data

Jun. 17, 2022 (KR) ..... 10-2022-0074443

(51) Int. Cl.
*F25B 31/00* (2006.01)
*F04C 29/02* (2006.01)
(Continued)

(52) U.S. Cl.
CPC ..... *F25B 31/002* (2013.01); *F04C 29/023* (2013.01); *F04D 3/00* (2013.01);
(Continued)

(58) Field of Classification Search
CPC .... F04C 29/023; F04D 29/061; F25B 31/002; F25B 31/004; F25B 31/026
See application file for complete search history.

(56) References Cited

U.S. PATENT DOCUMENTS 5,007,808 A 4/1991 Fraser, Jr. et al.
5,088,579 A 2/1992 Kim et al.
(Continued)

FOREIGN PATENT DOCUMENTS

CN 101275556 A 10/2008
CN 110425137 A 11/2019
(Continued)

OTHER PUBLICATIONS

PCT International Search Report for PCT/KR2023/005881 dated Aug. 18, 2023.

*Primary Examiner* — Christopher R Legendre
(74) *Attorney, Agent, or Firm* — CANTOR COLBURN LLP

(57) ABSTRACT

A rotary compressor includes a rotary shaft rotating in a first direction and defining each of an oil channel along which oil moves, an oil hole corresponding to a cylinder and a gas hole above the cylinder, and an oil paddle rotating in the first rotation direction together with the rotary shaft, the oil paddle including a first length region twisted in a second rotation direction opposite to the first rotation direction, and a second length region twisted in the first rotation direction, where rotation of the rotary shaft in the first rotation direction includes the first length region of the oil paddle transferring the oil along the oil channel and toward the gas hole, together with the second length region of the rotary shaft transferring the oil along the oil channel and away from the gas discharge hole.

20 Claims, 6 Drawing Sheets

(51) Int. Cl.

| | |
|---|---|
| ***F04D 3/00*** | (2006.01) |
| ***F04D 29/043*** | (2006.01) |
| ***F04D 29/06*** | (2006.01) |
| ***F04D 29/18*** | (2006.01) |
| ***F25B 31/02*** | (2006.01) |

(52) U.S. Cl.

CPC ..... *F04D 29/043* (2013.01); *F04D 29/061* (2013.01); *F04D 29/181* (2013.01); *F25B 31/026* (2013.01)

(56) References Cited

U.S. PATENT DOCUMENTS

| | | | | |
|---|---|---|---|---|
| 9,951,774 | B2 * | 4/2018 | Komai | F04C 29/023 |
| 2011/0027117 | A1 * | 2/2011 | Fujino | F04C 23/008 418/94 |
| 2014/0157751 | A1 | 6/2014 | Jackson | |
| 2019/0271314 | A1 | 9/2019 | Hill et al. | |
| 2021/0355943 | A1 | 11/2021 | Huang et al. | |
| 2021/0363994 | A1 * | 11/2021 | Nam | F04C 18/063 |
| 2022/0186731 | A1 * | 6/2022 | Heo | F04C 29/12 |
| 2023/0407877 | A1 * | 12/2023 | Kim | F04D 29/181 |

FOREIGN PATENT DOCUMENTS

| | | | | |
|---|---|---|---|---|
| CN | 111412140 | A | | 7/2020 |
| EP | 2295807 | B1 | | 8/2018 |
| JP | H0642485 | A | * | 2/1994 |
| JP | 2000249064 | A | * | 9/2000 |
| JP | 5748723 | B2 | | 5/2015 |
| JP | 6101613 | B2 | | 3/2017 |
| KR | 2019960029193 | A | | 9/1996 |
| KR | 20-1997-0000962 | Y1 | | 2/1997 |
| KR | 200128915 | Y1 | | 1/1999 |
| KR | 101337079 | B1 | | 12/2013 |

* cited by examiner

ROTARY COMPRESSOR AND HOME APPLIANCE INCLUDING THE SAME

CROSS-REFERENCE TO RELATED APPLICATION

This application is a continuation application of International Application No. PCT/KR2023/005881 designating the United States, filed on Apr. 28, 2023, in the Korean Intellectual Property Receiving Office and claiming priority to Korean Patent Application No. 10-2022-0074443 filed on Jun. 17, 2022 in the Korean Intellectual Property Office, the disclosure of which is incorporated by reference herein in its entirety.

BACKGROUND

(1) Field

Apparatuses and methods consistent with the disclosure relate to a rotary compressor in which upper and lower regions of an oil paddle are twisted in different directions to increase an oil supply rate, and a home appliance including the same.

(2) Description of the Related Art

A compressor is a mechanical device that increases pressure by compressing air, a refrigerant, or other various working gases using a motor or turbine. When used in a refrigerant cycle, the compressor may be used in various ways throughout the industry, and may convert a low-pressure refrigerant into a high-pressure refrigerant and transfer the high-pressure refrigerant to a condenser.

Compressors are largely divided into a reciprocating compressor in which a compression space for absorbing or discharging a working gas is provided between a piston and a cylinder to allow the piston to compress a refrigerant while making a linear reciprocating motion within the cylinder, a scroll compressor in which a compression space for absorbing or discharging a working gas is provided between an orbiting scroll and a fixed scroll to allow the orbiting scroll to compress a refrigerant while rotating about the fixed scroll, and a rotary compressor in which a compression space for absorbing or discharging a working gas is provided between a rolling piston rotating eccentrically and a cylinder to allow the rolling piston to compress a refrigerant while eccentrically rotating along an inner wall of the cylinder.

SUMMARY

In a rotary compressor of the related art, an oil paddle twisted only in one direction is inside a rotary shaft to be rotated together with the rotary shaft so as to raise or transmit oil stored in a case. The oil raised by the oil paddle is sprayed toward the outside of the rotary shaft through an oil hole defined in the rotary shaft, to perform lubrication and sealing operations. However, where a gas hole is defined in an upper part of the rotary shaft to remove a refrigerant from the inside of the rotary shaft when the compressor is initially started, the oil raised by the oil paddle may unintentionally leak to the outside through the gas hole.

The disclosure provides a rotary compressor in which upper and lower regions of an oil paddle are twisted (e.g., fixed in a twisted configuration relative to a rotation axis) in different directions to increase an oil supply rate, and a home appliance including the same.

According to an embodiment of the disclosure, a rotary compressor includes a case configured to store oil, a cylinder disposed inside the case, having an inner space, and including a rolling piston configured to rotate with eccentricity in the inner space and a vane configured to divide the inner space into a suction chamber and a compression chamber while in contact with the rolling piston, a rotary shaft configured to rotate in a first direction while being coupled to the rolling piston, and including an oil channel space formed in the rotary shaft in a longitudinal direction, an oil hole for communication of the oil channel space with the outside, and a gas hole above the oil hole, and an oil paddle accommodated in the oil channel space to be rotated together with the rotary shaft, in which the oil paddle includes a first region twisted in a second direction opposite to the first direction to raise the oil, and a second region located above the first region and twisted in the first direction to lower the oil.

The first region may be twisted in the second direction from a lower end to an upper end, and the second region may be twisted in the first direction from a lower end to an upper end.

The rotary shaft may rotate about a central axis in the longitudinal direction, the first region may be twisted in the second direction with respect to the central axis, and the second region may be twisted in the first direction with respect to the central axis.

The lower end of the second region may be located above the oil hole.

The upper end of the first region may be located below the oil hole.

The oil paddle may include a third region located between the first and second regions and having a flat plate shape.

A plurality of oil holes may be provided in a longitudinal direction of the rotary shaft, and the cylinder may be located below an uppermost oil hole among the plurality of oil holes.

The rotary compressor may further include a flange member configured to close the inner space of the cylinder, and the gas hole may be located above the flange member.

The oil hole and the gas hole may be formed in a radial direction of the oil channel space.

A lower end of the rotary shaft may be disposed adjacent to a lower surface of the case to be immersed in the oil.

At least one of the upper end or the lower end of the first region may have a flat plate shape.

At least one of the upper end or the lower end of the second region may have a flat plate shape.

The cylinder may include a first cylinder and a second cylinder that are disposed vertically, and the rotary compressor may further include a middle plate between the first and second cylinders, and a flange member configured to close the inner space of the cylinder and including a first flange above the first cylinder and a second flange below the second cylinder.

According to another embodiment of the disclosure, a home appliance controls a temperature through the exchange of heat with the outside using a refrigerant and includes a rotary compressor, in which the rotary compressor includes a case configured to store oil, a cylinder disposed inside the case, having an inner space, and including a rolling piston configured to rotate with eccentricity in the inner space and a vane configured to divide the inner space into a suction chamber and a compression chamber while in contact with the rolling piston, a rotary shaft configured to rotate in a first direction while being coupled to the rolling piston, and including an oil channel space formed in the rotary shaft in a longitudinal direction, an oil hole configured to communicate the oil channel space with the outside, and a gas hole above the oil hole, and an oil paddle accommodated in the oil channel space to be rotated together with the rotary shaft, where the oil paddle includes a first region twisted in a second direction opposite to the first direction to raise the oil, and a second region located above the first region and twisted in the first direction to lower the oil.

The home appliance may be an air conditioner, a refrigerator, or a freezer.

BRIEF DESCRIPTION OF THE DRAWINGS

The above and/or other aspects of the disclosure will be more apparent by describing embodiments of the disclosure with reference to the accompanying drawings, in which.

DETAILED DESCRIPTION

Figure 1:
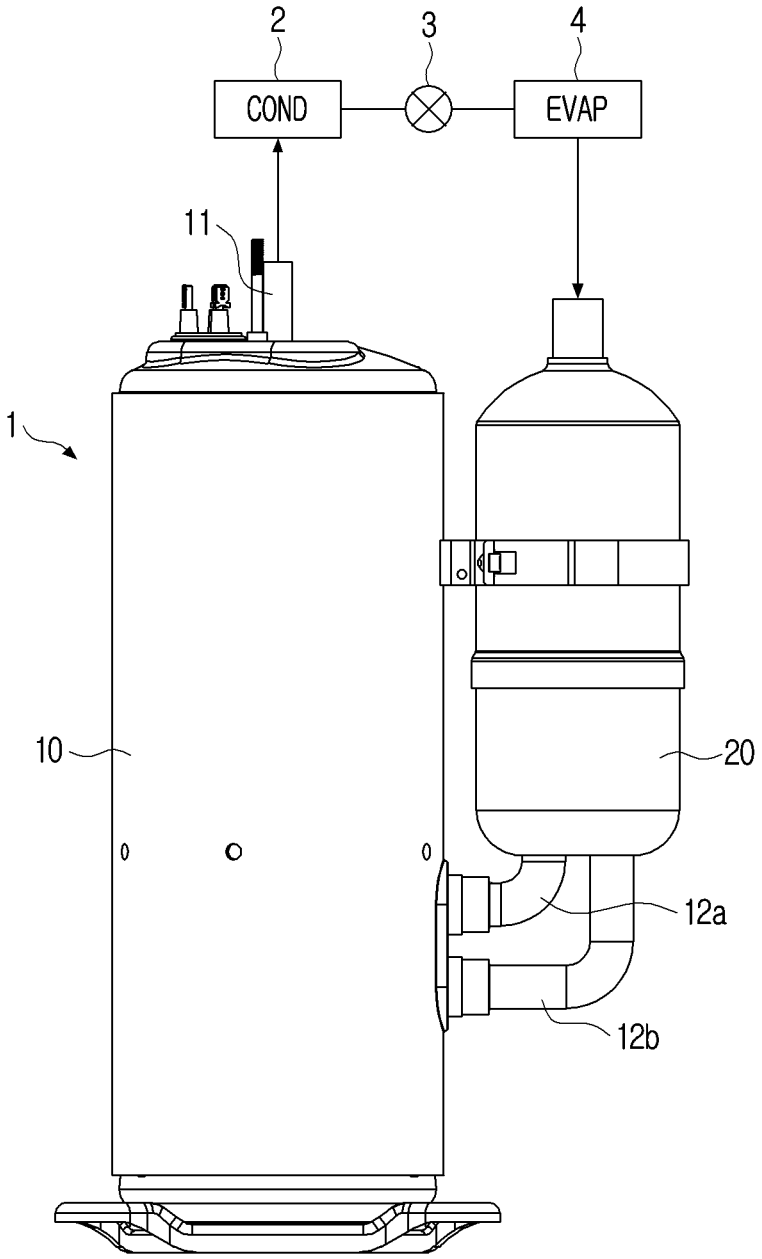
FIG. 1 is a perspective side view of a rotary compressor according to an embodiment of the disclosure.

Embodiments described below are provided as examples to help understand the disclosure, and it should be understood that the disclosure may be implemented in various forms different from these embodiments. Like reference numerals refer to like elements throughout.

In the following description of the disclosure, related well-known functions or components are not described in detail and are not illustrated in the drawings when it is determined that they would obscure the subject matter of the disclosure due to unnecessary detail. In the accompanying drawings, components are not shown in actual scale and the sizes of some components may be exaggerated to help understand the disclosure.

In the present specification and the claims, general terms are selected in consideration of the functions of the disclosure. However, non-general terms may be selected according to the intention of the technician in the art, legal or technical interpretation, the emergence of new technologies, etc. Some terms may be arbitrarily selected by the applicant. These terms may be interpreted as defined in the present specification, and may be interpreted based on the overall content of the present specification and the common technical knowledge in the technical field concerned when the terms are not specifically defined herein.

It will be understood that when an element is referred to as being related to another element such as being "on" another element, it can be directly on the other element or intervening elements may be present therebetween. In contrast, when an element is referred to as being related to another element such as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. Within the Figures and the text of the disclosure, a reference number indicating a singular form of an element may also be used to reference a plurality of the singular element. "At least one" is not to be construed as limiting "a" or "an." "Or" means "and/or." As used herein, the term "and/or" includes any and all combinations of one or more of the associated listed items As used herein, expressions such as "comprises," "comprising," "have", "may have," "include" or "may include" are intended to indicate the presence of features (e.g., a numerical value, a function, an operation, a component of a machine part, etc.) and do not exclude the presence of additional features.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Since the present specification describes exemplary components to describe each embodiment of the disclosure, the disclosure is not necessarily limited thereto. Accordingly, some components may be changed or omitted and other components may be added. In addition, components may be distributed and disposed in different independent devices.

Although embodiments of the disclosure will be described in detail herein with reference to the accompanying drawings and the content shown in the accompanying drawings, the disclosure is not limited to or limited by the embodiments.

Hereinafter, the disclosure will be described in more detail with reference to the accompanying drawings.

Figure 2:
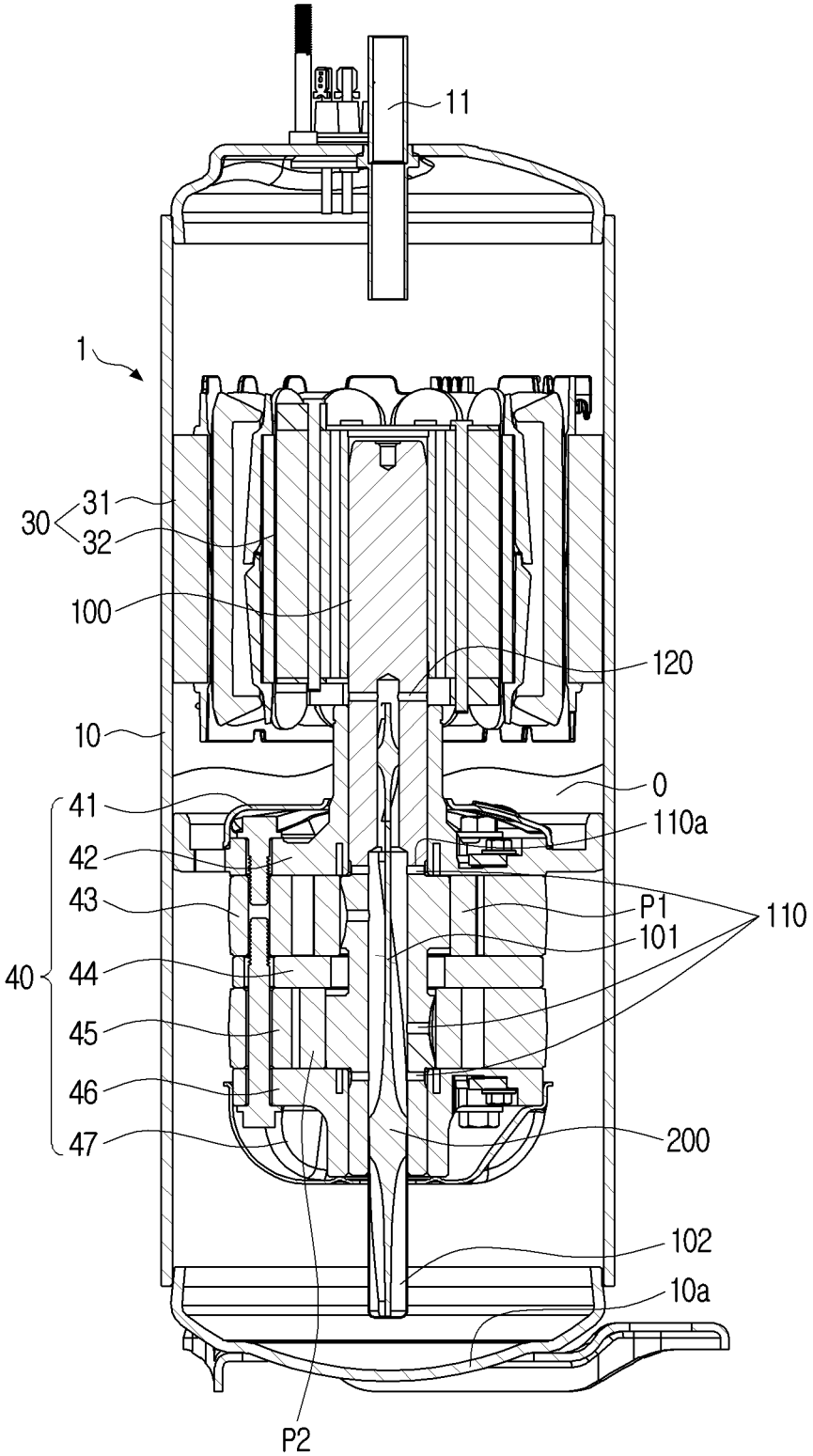
FIG. 2 is a cross-sectional view of a rotary compressor according to an embodiment of the disclosure.
Figure 3:
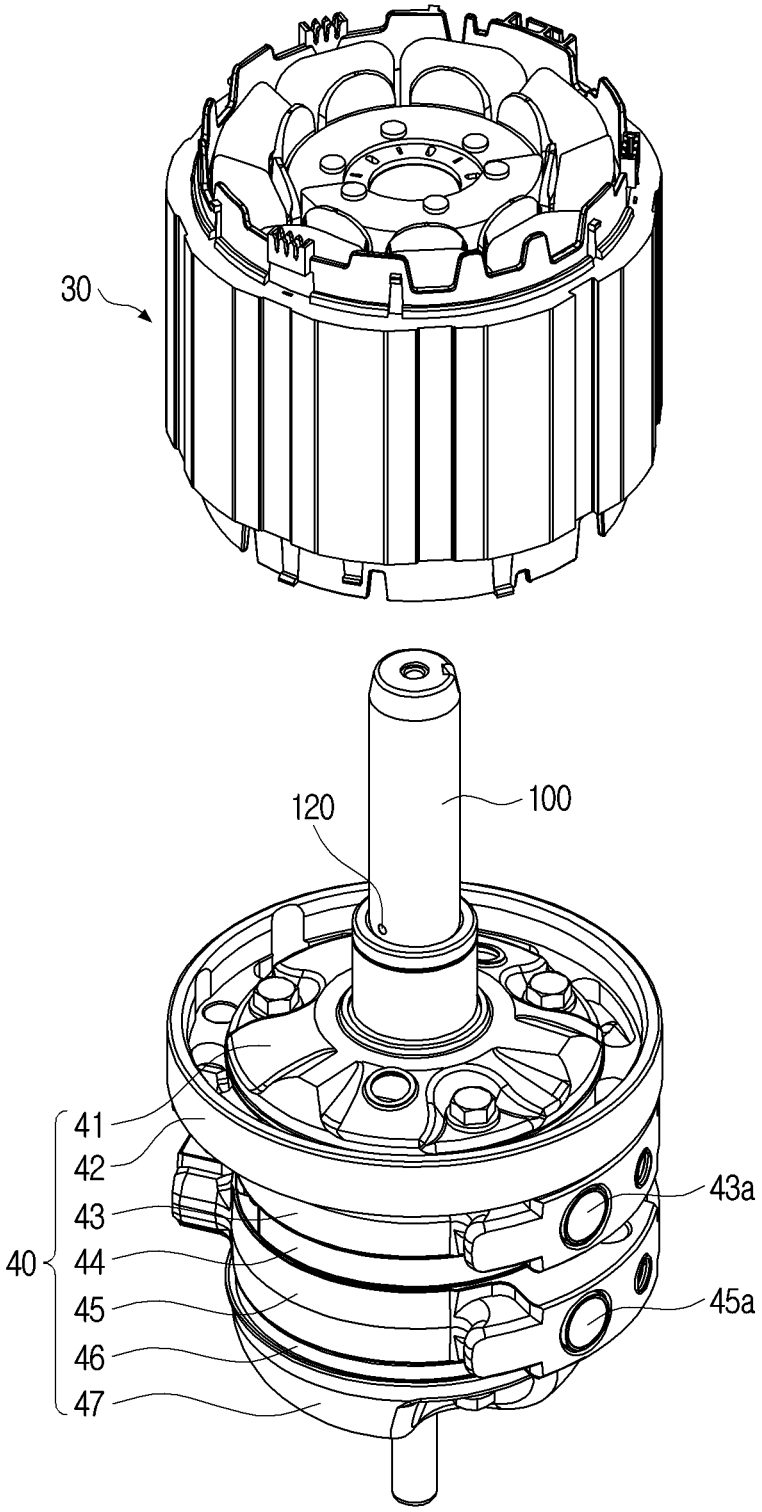
FIG. 3 is a perspective view of a driving part and a compressing part according to an embodiment of the disclosure.
Figure 4:
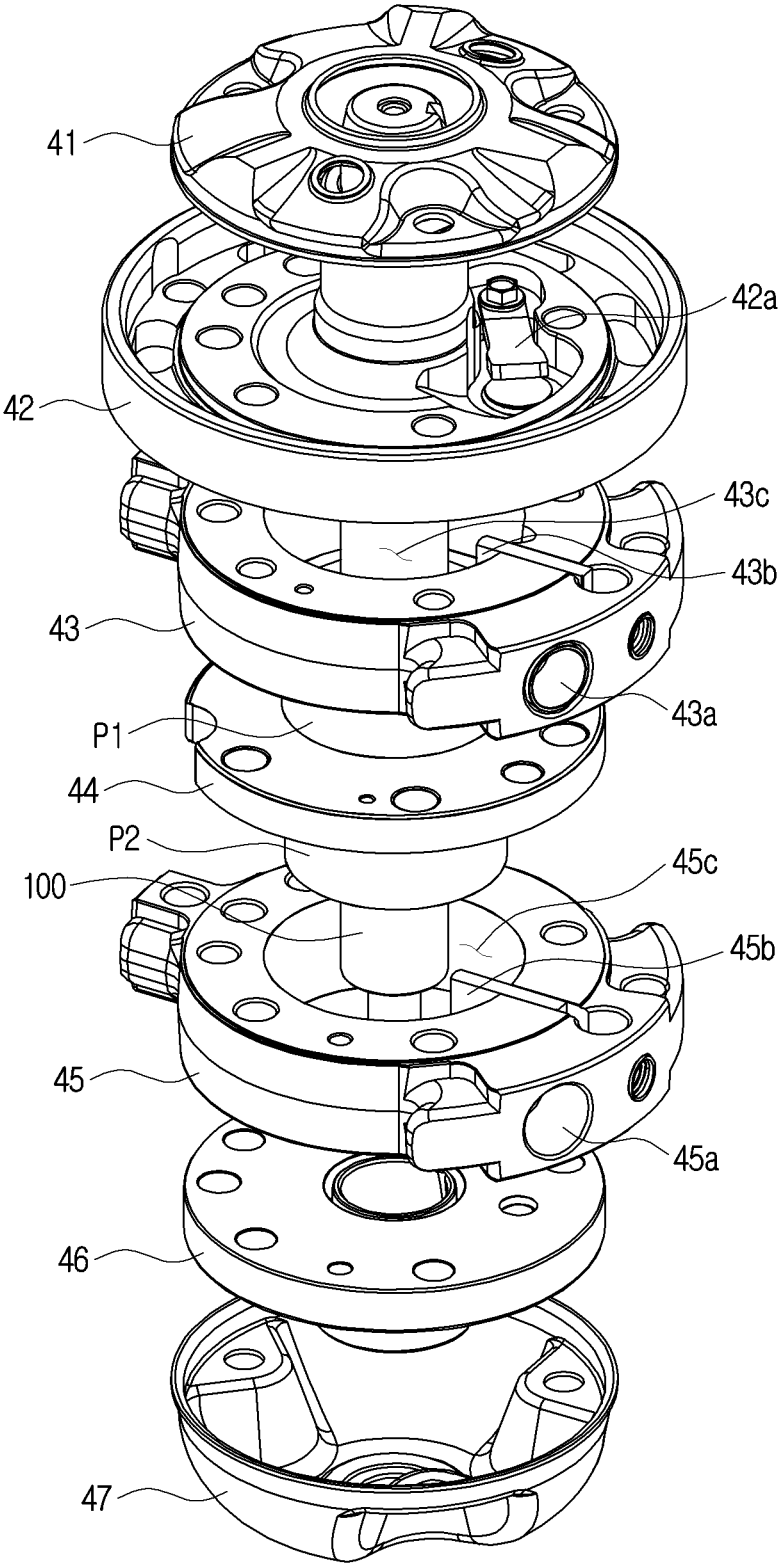
FIG. 4 is an exploded perspective view of a driving part and a compressing part according to an embodiment of the disclosure.

FIG. 1 is a perspective side view of a rotary compressor 1 according to an embodiment of the disclosure. FIG. 2 is a cross-sectional view of a rotary compressor 1 according to an embodiment of the disclosure. FIG. 3 is a perspective view of a driving part 30 (e.g., otherwise referred to as a driver or a compressor driver) and a compressing part 40 (e.g., otherwise referred to as a compressor) according to an embodiment of the disclosure. FIG. 4 is an exploded perspective view of a driving part 30 and a compressing part 40 according to an embodiment of the disclosure.

As shown in FIG. 1, a freeze cycle includes four strokes of compression, condensation, expansion, and evaporation, and the four strokes of compression, condensation, expansion, and evaporation occur as a refrigerant is circulated through a rotary compressor 1, a condenser 2 (e.g., COND), an expansion valve 3, and an evaporator 4 (e.g., EVAP).

The rotary compressor 1 compresses and discharges a refrigerant gas at a relatively high temperature and under a relatively high pressure (e.g., a high-temperature and high-pressure refrigerant gas) and the high-temperature and high-pressure refrigerant gas discharged from the rotary compressor 1 is introduced into the condenser 2.

The condenser 2 condenses the refrigerant gas which is compressed by the rotary compressor 1, into a liquid form during a condensation process (e.g., a condensed refrigerant gas), and heat as a byproduct is emitted to the outside during the condensation process.

The expansion valve 3 expands the condensed high-temperature and high-pressure refrigerant gas, in (or into) a low-pressure state (e.g., an expanded refrigerant gas or low-pressure expanded refrigerant). The evaporator 4 achieves a refrigerating effect through the exchange of heat with an object which is to be cooled, using evaporative latent heat while evaporating the expanded refrigerant gas in an evaporation process, to transfer the evaporated refrigerant gas, which is evaporated in a low-temperature and low-pressure state, back to the rotary compressor 1. The rotary compressor 1 may be disposed in an indoor space, and a temperature of air in the indoor space may be controlled using the refrigerating through the above-described cycle.

One or more embodiment includes a home appliance controlling a temperature (e.g., an internal temperature of the appliance, a temperature of an internal material, etc.) through heat exchange using a refrigerant. A home appliance equipped with such a cooling cycle described above using a refrigerant may be an air conditioner, a refrigerator, or a freezer. However, embodiments are not limited thereto and are applicable to various types of home appliances equipped with a cooling cycle.

The rotary compressor 1 may include refrigerant inlets 12*a* and 12*b* connected to the evaporator 4 to introduce a refrigerant from the evaporator 4, and a refrigerant outlet 11 connected to the condenser 2 to discharge a refrigerant compressed at high temperature and under high pressure from the rotary compressor 1.

The rotary compressor 1 may further include a case 10 that forms an exterior appearance of the rotary compressor 1, a compressing part 40 included in the case 10 to compress the refrigerant introduced into the case 10 through the refrigerant inlets 12*a* and 12*b*, and a driving part 30 connected to the compressing part 40 to drive the compressing part 40.

The refrigerant inlets 12*a* and 12*b* according to an embodiment of the disclosure may branch from an accumulator 20 and be connected to a first cylinder 43 and a second cylinder 45, respectively.

The case 10 may be sealed to divide the case 10 into the inside (e.g., an interior or inner space) and the outside (e.g., an exterior or external space) and discharge a refrigerant compressed by the compressing part 40 only through the refrigerant outlet 11. The case 10 may be formed in various shapes in cross-section as necessary. Oil O may be stored in a bottom of the case 10.

The accumulator 20 may be disposed between each of the refrigerant inlets 12*a* and 12*b* of the rotary compressor 1, and the evaporator 4, respectively. The accumulator 20 may temporarily store a part (or portion of the low-temperature and low-pressure refrigerant supplied from the evaporator 4, which does not change into a gas and is in a liquid form, to prevent the refrigerant, which is in the liquid form, flowing into the rotary compressor 1. That is, only the refrigerant that is in the liquid form remains in the accumulator 20, and the refrigerant that is a gaseous state may be introduced into the rotary compressor 1.

The driving part 30 may include a stator 31 fixed on an inner side of the case 10 and a rotor 32 which is rotatably installed inside the stator 31 to be rotatable. A rotary shaft 100 may be provided inside the rotor 32 to be rotatable together with the rotor 32.

In addition, the rotary shaft 100 may be coupled to the compressing part 40 to rotate rolling pistons P1 and P2 of the compressing part 40 so as to compress a refrigerant introduced into the compressing part 40.

Accordingly, the driving part 30 may be connected to the compressing part 40, through the rotary shaft 100, to transmit power to the compressing part 40.

The compressing part 40 may include an upper muffler 41, flange members 42 and 46, cylinders 43 and 45, a middle plate 44, and a lower muffler 47.

The rotary compressor 1 may have various dimensions along different directions. Referring to FIGS. 1 and 2, for example, a vertical direction may define a first direction, a horizontal direction in FIG. 1 may define a second direction, and a horizontal direction in FIG. 2 may define a third direction, where the first to third directions cross each other.

The cylinders 43 and 45 may include a first cylinder 43 and a second cylinder that are disposed vertically. The middle plate 44 may be disposed between the first and second cylinders 43 and 45 along the vertical (or height) direction of the rotary compressor 1. The flange members 42 and 46 may include a first flange member 42 on the first cylinder 43 and a second flange member 46 below the second cylinder 45 to close an inner space 43*c* of the cylinder 43 and an inner space 45*c* of the cylinder 45.

The inner space 43*c* of the first cylinder 43 may be closed by the first flange member 42 and the middle plate 44 together with each other to define an enclosed space. The inner space 45*c* of the second cylinder 45 may be closed by the second flange member 46 and the middle plate 44 together with each other. In an embodiment, the flange member as one or more of the flange members 42 and 46, with or without the middle plate 44, is inside the case and encloses the inner space of the cylinder. Here, the gas discharge hole is above the flange member, along the longitudinal direction.

The first flange member 42 may include a valve member 42*a* on an upper side thereof to selectively discharge the refrigerant compressed in the first cylinder 43. The second flange member 46 may include a valve member (not shown)

on a lower side thereof to selectively discharge the refrigerant compressed in the second cylinder 45.

The rotary compressor 1 according to an embodiment of the disclosure is illustrated as a double cylinder structure but is not limited thereto and may have a single cylinder structure.

The first and second cylinders 43 and 45 may be disposed inside the case 10, may respectively have the inner spaces 43*c* and 45*s*, and respectively include the rolling pistons P1 and P2 that rotate with eccentricity in the inner spaces 43*c* and 45*c*, and vanes 43*b* and 45*b* that are in contact with the rolling pistons P1 and P2 to divide each of the inner spaces 43*c* and into a suction chamber and a compression chamber. The first and second cylinders 43 and may respectively include intakes 43*a* and 45*a* for communication with the outside (e.g., outside of the compressing part 40), and the inner spaces 43*c* and 45*c*, respectively.

The rolling pistons P1 and P2 are formed in a cylindrical shape, and eccentric parts 131 and 132 coupled to the rotary shaft 100 may be disposed in the rolling pistons P1 and P2, respectively. As the rotary shaft 100 rotates, the eccentric parts 131 and 132 are moved to cause the rolling pistons P1 and P2 to be moved while being rotated. The rolling pistons P1 and P2 of the first and second cylinders 43 and 45 may be rotated eccentrically to be 180 degrees out of phase with each other in the circumferential direction of the rotary shaft 100.

The inner spaces 43*c* and 45*c* of the first and second cylinders 43 and 45 are spaces in which a refrigerant is suctioned and compressed and may have a cylindrical shape but the shapes in cross-section or in three-dimension thereof may vary depending on the shapes of the rolling pistons P1 and P2.

The first and second cylinders 43 and 45 may include elastic members (not shown) for continuously pressing (e.g., biasing) the vanes 43*b* and 45*b* toward the rolling pistons P1 and P2. Accordingly, even when the rolling pistons P1 and P2 are moved while being rotated in the inner spaces 43*c* and 45*c* due to the rotation of the rotary shaft 100, the vanes 43*b* and 45*b* may be in continuous contact with the rolling pistons P1 and P2 due to the elastic members. Thus, when the rolling piston P1 and P2 are moved while being rotated, the inner spaces 43*c* and 45*c* of the first and second cylinder 43 and 45 may be divided into a suction chamber and a compression chamber.

For example, the suction chamber of the first cylinder 43 may be connected to the intake 43*a*, and a refrigerant introduced through the intake 43*a* may be stored in the suction chamber. The compression chamber of the second cylinder 45 is a space in which the introduced refrigerant is compressed by a turning movement of the rolling piston P2, and the volume thereof may repeatedly increase or decrease (e.g., one of increase and decrease) due to the turning movement of the rolling piston P2.

The upper muffler 41 may cover an upper surface of the first flange member 42. The lower muffler 47 may cover a lower surface of the second flange member 46. Accordingly, the noise of a refrigerant gas discharged from the flange members 42 and 46 may decrease.

Figure 5:
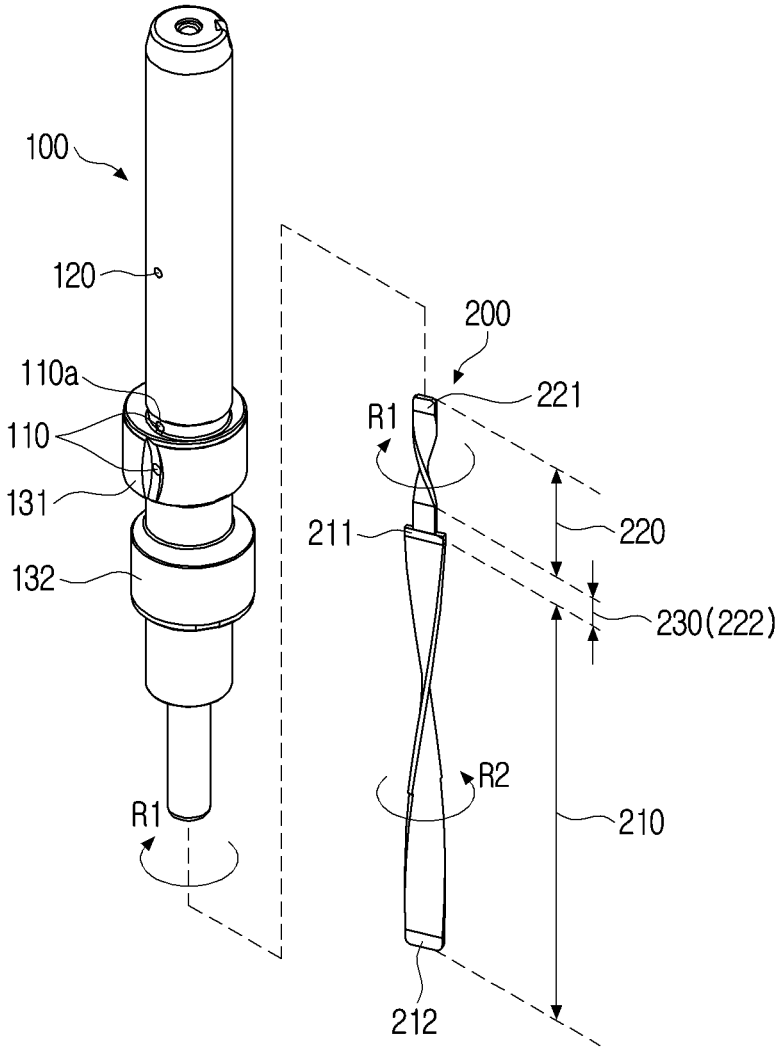
FIG. 5 is an exploded perspective view of a rotary shaft and an oil paddle according to an embodiment of the disclosure.

The rotary shaft 100 may rotate in a first rotation direction R1 of FIG. 5 while being coupled to the rolling pistons P1 and P2. The rotary shaft 100 may include or define an oil channel space 101 formed therein in a longitudinal direction, an oil hole 110 for communication of the oil channel space 101 with an outside of the rotary shaft 100, and a gas hole 120 above the oil hole 110.

A lower end 102 of the rotary shaft 100 may be located adjacent to or corresponding to a lower surface 10*a* of the case 10, to be immersed in the oil O. In an embodiment, the case 10 stores the oil O, each of the rotary shaft 100 and the case 10 includes a lower end furthest from the gas discharge hole (e.g., the gas hole 120), and the lower end of the rotary shaft 100 is immersed in the oil O which is stored in the case 10, at the lower end of the case 10.

The rotary compressor 1 may include an oil paddle 200 accommodated in the oil channel space 101 to be rotated with the rotary shaft 100 (e.g., rotatable together with rotation of the rotary shaft 100).

When the rotary shaft 100 rotates, the oil O may be raised along the oil channel space 101 by the oil paddle 200, in a vertical flow direction from the lower surface 10*a* toward the refrigerant outlet 11, and sprayed toward the components of the compressing part 40 such as in a radial direction, through the oil hole 110 as an oil discharge hole. Accordingly, the components of the compressing part 40 may be lubricated with the oil O (e.g., the radially-sprayed oil) and gaps between the components may be sealed with the oil O, thus preventing the refrigerant from being unintentionally discharged.

The oil channel space 101 of the rotary shaft 100 is filled with a refrigerant gas and thus the refrigerant gas may interfere with the flow of the oil O before the rotary compressor 1 is started. When the rotary compressor 1 is started, the refrigerant gas in the oil channel space 101 may be removed by being discharged to the outside of the rotary shaft 100 through the gas hole 120 as a gas discharge hole. That is, the gas hole 120 may be defined by portions of the rotary shaft 100 and be in communication (e.g., fluid communication) with the oil channel space 101 and an outside of the rotary shaft 100. In an embodiment, the gas of the refrigerant which is compressed by the rotary compressor 1 is moveable along the oil channel space 101, the rotation of the rotary shaft 100 in the first rotation direction further includes the gas of the refrigerant which is in the oil channel space 101 being moved in the oil channel space 101 and discharged through the gas discharge hole of the rotary shaft 100.

The oil hole 110 and the gas hole 120 may be formed to extend in a radial direction of the oil channel space 101, that is, have a major dimension in the radial direction. The oil hole 110 and the gas hole 120 may be formed horizontally. The major dimension of one or more of the oil hole 110 and the gas hole 120 may be minimal when defined along the horizontal direction.

A plurality of oil holes 110 may be defined (or formed) in (or along) a longitudinal direction of the rotary shaft 100. The plurality of oil holes 110 may be arranged along the vertical direction of the rotary shaft 100. The cylinders 43 and 45 may be provided below an uppermost oil hole 110*a* among the plurality of oil holes 110. That is, the uppermost oil hole 110*a* may be located above the cylinders 43 and 45. In an embodiment, the rotary shaft 100 further defines the oil discharge hole (e.g., the oil hole 110) in plural including a plurality of oil holes 110 arranged along the longitudinal direction, and an uppermost oil hole 110*a* which is closest to the gas discharge hole among the plurality of oil holes 110, and the cylinder (e.g., one or more of the cylinders 43 and 45) is below the uppermost oil hole 110*a*.

The gas hole 120 may be located above the flange members 42 and 46. Specifically, the gas hole 120 may be located above the first flange member 42 and formed horizontally from the oil channel space 101 and extended toward the driving part 30.

Figure 6:
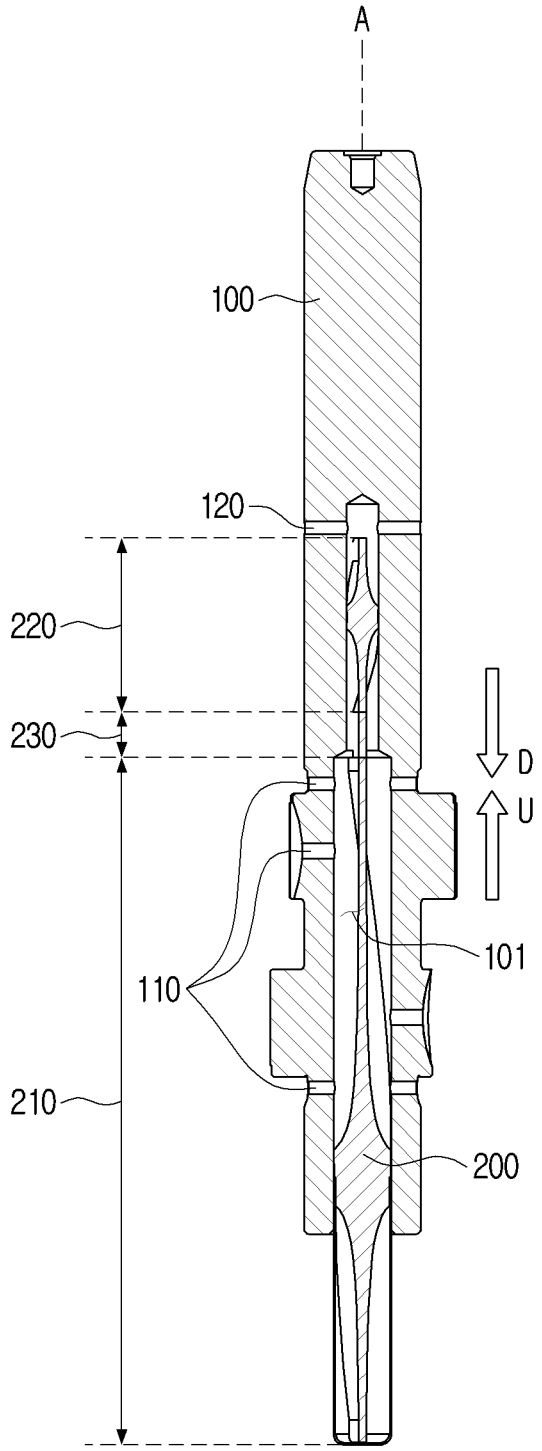
FIG. 6 is a cross-sectional view of a rotary shaft and an oil paddle according to an embodiment of the disclosure.

FIG. 5 is an exploded perspective view of a rotary shaft 100 and an oil paddle 200 according to an embodiment of the disclosure. FIG. 6 is a cross-sectional view of a rotary shaft 100 and an oil paddle 200 according to an embodiment of the disclosure.

According to an embodiment of the disclosure, the oil paddle 200 may include a first region 210 and a second region 220 in the longitudinal direction. The first region 210 may extend from the second region 220, along the length of the oil paddle 200, to define a first length region of the oil paddle 200.

The oil paddle 200 may include a flat plate which is twisted about a rotation axis, at more than one location along the length of the oil paddle 200, to define a second length region of the oil paddle 200. The first region 210 may be twisted in a second rotation direction R2 opposite to the first rotation direction R1 such that rotation of the oil paddle 200 raises the oil O in a direction from the compressing part 40 to the driving part 30 in a direction along the height of the rotary compressor 1. That is, the oil O stored in the oil channel space 101 may be raised by contact with an outer surface of the first region 210 that is being rotated in the first rotation direction R1 together with rotation of the rotary shaft 100 since the flat plate profile of the oil paddle 200 is fixedly twisted in the second rotation direction R2 at the first region 210.

The second region 220 as an upper end region of the oil paddle 200 may be located above the first region 210 and fixedly twisted in the first rotation direction R1 to affect a lowering of the oil O. That is, the oil O stored in the oil channel space 101 may be lowered by contact with an outer surface of the second region 220 that is being rotated in the first rotation direction R1 together with rotation of the rotary shaft 100, since the flat plate profile of the oil paddle 200 is fixedly twisted in the first rotation direction R1 at the second region 220.

Referring to FIGS. 2 and 5, for example, a location of the first region 210 of the oil paddle 200 corresponds to a location of the oil hole 110, along a length (or height) of the oil channel space 101. Accordingly, the oil O may be easily raised to a height corresponding to the first region 210 and discharged to the outside through the oil hole 110, together with a downward force D may be applied to the oil O due to the second region 220, thereby preventing the oil O from unintentionally leaking through the gas hole 120. That is, rotation of the rotary shaft 100 in the first rotation direction includes the first length region (e.g., the first region 210) of the oil paddle 200 transferring the oil O along the oil channel space 101 and in the longitudinal direction, toward the gas discharge hole, together with the second length region (e.g., the second region 220) of the rotary shaft 100 transferring the oil O along the oil channel space 101 and in the longitudinal direction, away from the gas discharge hole.

That is, as the amount of the oil O discharged through the oil hole 110 increases, an oil discharging rate to the case 10 from the driving part 30 and/or the compressing part 40 may decrease, the sealing performance of the compressing part 40 may improve, thus improving cooling performance, and the amount of the oil O filling the inside of the case 10 may decrease, thus reducing costs.

Additionally, an oil supply rate may increase, since the discharge pressure of the oil O increases sharply in a region to an upward force U to be applied to the first region 210 and a downward force D to be applied to the second region 220 are applied simultaneously.

The first region 210 may be fixedly twisted in the second rotation direction R2, from a lower end 212 to an upper end 211. The second region 220 may be fixedly twisted in the first rotation direction R1, from a lower end 222 to an upper end 221. That is, each of the first length region and the second length region includes both a lower end furthest from the gas discharge hole and an upper end closest to the gas discharge hole.

The rotary shaft 100 may rotate about a central axis A as a rotation axis extended in the longitudinal direction. The first region 210 may be fixedly twisted in the second rotation direction R2 with respect to the central axis A, and the second region 220 may be fixedly twisted in the first rotation direction R1 with respect to the central axis A.

The lower end 222 of the second region 220 may be located above the oil hole 110. Accordingly, the oil O may be easily raised to a height at which the oil hole 110 is located by an upward force U applied by the first region 210.

The upper end 211 of the first region 210 may be located below the uppermost oil hole 110*a*. Accordingly, the oil O cannot be easily raised to a height at which the gas hole 120 is located due to a downward force D applied by the second region 220.

The oil paddle 200 may include a third region 230 (e.g., a third length region) located between the first and second regions 210 and 220 and having a flat plate shape. The oil paddle 200 may be flat (e.g., untwisted at the third region 230). Referring to FIG. 5, for example, a width in a radial direction of the oil paddle 200 at the first region 210 may be greater than a width in the radial direction of the second region 220 and/or the third region 230.

The third region 230 may indicate the lower end 222 of the second region 220. The position of the second region 220 may be adjusted using the length of the third region 230 in a length direction of the oil paddle 200. For example, a height of the second region 220 from bottom end of the oil channel space 101 may be raised (e.g., positioned further from the bottom end) by increasing the length of the third region 230 or lowered (e.g., positioned closer to the bottom end) by reducing the length of the third region 230. The third region 230 may be a length portion of the oil paddle 200 at which a fixed rotation direction of length portions of the oil paddle 200 is changed. In an embodiment, an upper length portion (e.g., the second region 220) of the oil paddle 200 has a first fixed rotation direction (e.g., the same as the first rotation direction R1), together with the lower length portion (e.g., the first region 210) having a second fixed rotation opposite to the first fixed rotation direction (e.g., the second rotation direction R2)

The upper end 211 and the lower end 212 may be opposing ends of the first region 210. Similarly, the upper end 221 and the lower end 222 may be opposing ends of the second region 220. The upper end 221 and the lower end 212 may each be a distal end among opposing ends of the oil paddle 200. At least one of the upper end 211 or the lower end 212 of the first region 210 may have a flat plate shape or be fixedly untwisted relative to a middle portion fixedly twisted between the opposing ends thereof. At least one of the upper end 221 or the lower end 222 of the second region 220 may have a flat plate shape. Accordingly, the upper end 211 of the first region 210 and the lower end 222 of the second region 220 may be easily combined with each other.

Referring again to FIG. 6, along the longitudinal direction (e.g., parallel to the central axis A), the oil channel space 101 further defines a first channel length corresponding to the cylinder (e.g., a portion of the oil channel space 101 which corresponds to the first region 210), and a second channel length which is connected to the first channel length, and extends further than an upper end of the cylinder and toward the gas discharge hole 120 of the rotary shaft 100 (e.g., a portion of the oil channel space 101 which corresponds to the second region 220). The oil paddle 200 which is in the oil channel space 101 includes the first length region of the oil paddle 200 corresponding to the first channel length, and the second length region of the oil paddle 200 corresponding to the second channel length.

For example, after preparing or providing two flat plates corresponding to the first and second regions 210 and 220, the lower end 212 of the first region 210 may be fixed flat, the upper end 211 of the first region 210 may be twisted in the second rotation direction R2, the lower end 222 of the second region 220 may be fixed flat, the upper end 221 of the second region 220 may be twisted in the first rotation direction R1, and the upper end 211 of the first region 210 and the lower end 222 of the second region 220 which are flat may be combined with each other to define the third region 230. Accordingly, the oil paddle 200 twisted in different directions at different locations along the length of the oil paddle 200 may be manufactured. However, the method of manufacturing or providing the oil paddle 200 is not limited thereto and the oil paddle 200 may be manufactured by fixing a middle part of one flat plate such as at the third region 230, and twisting an upper end section (e.g., at the second region 220) and a lower end section (e.g., at the first region 210) of the flat panel in the same direction.

In one or more embodiment, a home appliance includes a rotary compressor 1 which compresses a gas of the refrigerant, where the rotary compressor 1 includes a case 10 extended in a longitudinal direction, a cylinder which is inside the case 10 and is lubricated by oil O, the cylinder defining an inner space of the cylinder, and including a rolling piston which rotates eccentrically within the inner space of the cylinder, a rotary shaft 100 which extends along the inner space of the cylinder, is coupled to the rolling piston and rotates in a first rotation direction, the rotary shaft defining an oil channel space 101 of the rotary shaft 100 which extends along the longitudinal direction and along which the oil O moves, together with along the oil channel space an oil discharge hole 110 of the rotary shaft 100 which corresponds to the cylinder and fluidly connects the oil channel space 101 with outside of the rotary shaft 100, and a gas discharge hole of the rotary shaft 100 which is above the cylinder and fluidly connects the oil channel space 101 with the outside the rotary shaft 100, and an oil paddle 200 which is in the oil channel space 101 and rotates in the first rotation direction together with the rotary shaft 100. The oil paddle 200 includes a first length region twisted in a second rotation direction opposite to the first rotation direction, and a second length region which is closer to the gas discharge hole 120 than the first length region and twisted in the same direction as the rotation of the rotary shaft 100. Here, rotation of the rotary shaft 100 in the first rotation direction includes the first length region of the oil paddle 200 transferring the oil O along the oil channel space 101 and in the longitudinal direction, toward the gas discharge hole 120, together with the second length region of the rotary shaft 100 transferring the oil O along the oil channel space 101 and in the longitudinal direction, away from the gas discharge hole 120.

In an embodiment of the home appliance, the gas of the refrigerant is moveable along the oil channel space 101, the rotation of the rotary shaft 100 in the first rotation direction further includes the oil paddle 200 moving the gas of the refrigerant within the oil channel space 101 and discharging the gas of the refrigerant which is moved, to outside the rotary shaft 100, through the gas discharge hole 120 of the rotary shaft 100.

Although embodiments of the disclosure have been illustrated and described herein, it should be understood that the disclosure is not limited thereto, various modifications may be made by those of ordinary skill in the art without departing from the gist of the disclosure defined in the appended claims, and such modifications fall within the scope defined in the claims.

What is claimed is:

1. A rotary compressor comprising:

a case extended in a longitudinal direction;

a cylinder which is inside the case and is lubricated by oil, the cylinder defining an inner space of the cylinder, and including a rolling piston which rotates within the inner space of the cylinder;

a rotary shaft which extends along the inner space of the cylinder, is coupled to the rolling piston and rotates in a first rotation direction, the rotary shaft defining:

an oil channel space of the rotary shaft which extends along the longitudinal direction and along which the oil moves, and along the oil channel space:

an oil discharge hole of the rotary shaft which corresponds to the cylinder and fluidly connects the oil channel space with outside of the rotary shaft, and a gas discharge hole of the rotary shaft which is above the cylinder and fluidly connects the oil channel space with the outside of the rotary shaft; and an oil paddle which is in the oil channel space and rotates in the first rotation direction together with the rotary shaft, the oil paddle comprising:

a first length region twisted in a second rotation direction opposite to the first rotation direction, and a second length region which is closer to the gas discharge hole than the first length region and twisted in the first rotation direction, wherein rotation of the rotary shaft in the first rotation direction includes the first length region of the oil paddle transferring the oil along the oil channel space and in the longitudinal direction, toward the gas discharge hole, together with the second length region of the rotary shaft transferring the oil along the oil channel space and in the longitudinal direction, away from the gas discharge hole.

2. The rotary compressor as claimed in claim 1, wherein the oil paddle further comprises:

each of the first length region and the second length region including both a lower end furthest from the gas discharge hole and an upper end closest to the gas discharge hole, the first length region being twisted in the second rotation direction, from the lower end of the first length region to the upper end of the first length region, and the second length region being twisted in the first rotation direction from the lower end of the second length region to the upper end of the second length region.

3. The rotary compressor as claimed in claim 1, wherein the rotary shaft rotates about a rotation axis extended along the longitudinal direction, the first length region of the oil paddle is twisted in the second rotation direction with respect to the rotation axis of the rotary shaft, and the second length region of the oil paddle is twisted in the first rotation direction with respect to the rotation axis of the rotary shaft.

4. The rotary compressor as claimed in claim 1, wherein the second length region of the oil paddle includes both a lower end furthest from the gas discharge hole and an upper end closest to the gas discharge hole, and along the longitudinal direction, the lower end of the second length region is above the oil discharge hole.

5. The rotary compressor as claimed in claim 1, wherein the rotary shaft further defines the oil discharge hole in plural including:

a plurality of oil holes arranged along the longitudinal direction, and an uppermost oil hole which is closest to the gas discharge hole among the plurality of oil holes, the first length region of the oil paddle includes both a lower end furthest from the gas discharge hole and an upper end closest to the gas discharge hole, and the upper end of the first length region of the oil paddle is below the uppermost oil hole.

6. The rotary compressor as claimed in claim 1, wherein the oil paddle further comprises a third length region which is between the first length region and the second length region and has a flat plate shape.

7. The rotary compressor as claimed in claim 1, wherein the rotary shaft further defines the oil discharge hole in plural including:

a plurality of oil holes arranged along the longitudinal direction, and an uppermost oil hole which is closest to the gas discharge hole among the plurality of oil holes, and the cylinder is below the uppermost oil hole.

8. The rotary compressor as claimed in claim 1, further comprising a flange member which is inside the case and encloses the inner space of the cylinder, wherein the gas discharge hole is above the flange member, along the longitudinal direction.

9. The rotary compressor as claimed in claim 1, wherein the oil discharge hole and the gas discharge hole each extend in a radial direction of the oil channel space.

10. The rotary compressor as claimed in claim 1, wherein the case stores the oil, each of the rotary shaft and the case includes a lower end furthest from the gas discharge hole, and the lower end of the rotary shaft is immersed in the oil which is stored in the case, at the lower end of the case.

11. The rotary compressor as claimed in claim 1, wherein the first length region of the oil paddle includes both a lower end furthest from the gas discharge hole and an upper end closest to the gas discharge hole, and at least one of the upper end or the lower end of the first length region has a flat plate shape.

12. The rotary compressor as claimed in claim 1, wherein the second length region of the oil paddle includes both a lower end furthest from the gas discharge hole and an upper end closest to the gas discharge hole, and at least one of the upper end or the lower end of the second length region has a flat plate shape.

13. The rotary compressor as claimed in claim 1, further comprising:

the cylinder comprising a first cylinder and a second cylinder arranged along the longitudinal direction, a middle plate between the first cylinder and the second cylinder, along the longitudinal direction; and a flange member which encloses the inner space of the cylinder, the flange member including a first flange above the first cylinder and a second flange below the second cylinder, along the longitudinal direction.

14. The rotary compressor as claimed in claim 1, further comprising a driver which is connected to the rotary shaft and drives the rotation of the rotary shaft, wherein the rolling piston rotates eccentrically within the inner space of the cylinder.

15. A home appliance controlling temperature through heat exchange using a refrigerant, comprising:

a rotary compressor which compresses a gas of the refrigerant, the rotary compressor comprising:

a case extended in a longitudinal direction;

a cylinder which is inside the case and is lubricated by oil, the cylinder defining an inner space of the cylinder, and including a rolling piston which rotates within the inner space of the cylinder;

a rotary shaft which extends along the inner space of the cylinder, is coupled to the rolling piston and rotates in a first rotation direction, the rotary shaft defining:

an oil channel space of the rotary shaft which extends along the longitudinal direction and along which the oil moves, and along the oil channel space:

an oil discharge hole of the rotary shaft which corresponds to the cylinder and fluidly connects the oil channel space with outside of the rotary shaft, and a gas discharge hole of the rotary shaft which is above the cylinder and fluidly connects the oil channel space with the outside the rotary shaft; and an oil paddle which is in the oil channel space and rotates in the first rotation direction together with the rotary shaft, the oil paddle comprising:

a first length region twisted in a second rotation direction opposite to the first rotation direction, and a second length region which is closer to the gas discharge hole than the first length region and twisted in the first rotation direction, wherein rotation of the rotary shaft in the first rotation direction includes the first length region of the oil paddle transferring the oil along the oil channel space and in the longitudinal direction, toward the gas discharge hole, together with the second length region of the rotary shaft transferring the oil along the oil channel space and in the longitudinal direction, away from the gas discharge hole.

16. The home appliance as claimed in claim 15, wherein the home appliance is one of an air conditioner, a refrigerator and a freezer.

17. The home appliance as claimed in claim 15, wherein the gas of the refrigerant is moveable along the oil channel space, the rotation of the rotary shaft in the first rotation direction further includes the oil paddle moving the gas of the refrigerant within the oil channel space and discharging the gas of the refrigerant which is moved, to outside the rotary shaft, through the gas discharge hole of the rotary shaft.

18. The home appliance as claimed in claim 15, wherein along the longitudinal direction, the oil channel space further defines:

a first channel length corresponding to the cylinder, and a second channel length which is connected to the first channel length, and extends further than an upper end of the cylinder and toward the gas discharge hole of the rotary shaft, and the oil paddle which is in the oil channel space includes:

the first length region corresponding to the first channel length, and the second length region corresponding to the second channel length.

19. The home appliance as claimed in claim 18, wherein along the longitudinal direction, the second channel length of the oil channel space corresponds to the gas discharge hole of the rotary shaft.

20. The home appliance as claimed in claim 18, wherein the rotary shaft further defines the oil discharge hole in plural including:

a plurality of oil holes arranged along the longitudinal direction, and an uppermost oil hole which is closest to the gas discharge hole among the plurality of oil holes, and the first channel length of the oil channel space corresponds to the uppermost oil hole.

* * * * *